United States Patent [19]

Smith

[11] 4,197,827

[45] Apr. 15, 1980

[54] COACTING WHEEL BALL PROJECTING DEVICE

[76] Inventor: Tommy L. Smith, P.O. Box 517, Aurora, Oreg. 97002

[21] Appl. No.: 850,472

[22] Filed: Nov. 11, 1977

[51] Int. Cl.[2] ..... F41B 15/00

[52] U.S. Cl. ..... 124/78; 273/260; 124/81

[58] Field of Search ..... 124/78, 30 R, 32, 81, 124/82, 41 R, 49, 50, 1; 273/26 D, DIG. 8, DIG. 29; 414/129

[56] References Cited

U.S. PATENT DOCUMENTS

| | | | |
|---|---|---|---|
| 1,204,468 | 11/1916 | Marty | 273/26 D X |
| 2,316,798 | 4/1943 | Luebbe | 124/78 X |
| 2,448,756 | 9/1948 | Agens | 273/DIG. 29 |
| 2,729,206 | 1/1956 | Wilson | 124/78 |
| 2,918,915 | 12/1959 | Doeg | 124/78 |
| 3,459,168 | 8/1969 | Bruce | 124/78 |
| 3,538,900 | 11/1970 | Samuels | 124/78 |
| 3,604,409 | 9/1971 | Doeg | 124/78 |
| 3,724,437 | 4/1973 | Halstead | 124/78 |
| 3,734,075 | 5/1973 | Staples | 124/78 |
| 3,762,707 | 10/1973 | Santorelli | 273/DIG. 29 X |
| 3,777,732 | 12/1973 | Holloway et al. | 124/78 |
| 3,785,358 | 1/1974 | D'Angelo et al. | 124/78 |
| 3,794,011 | 2/1974 | Newgarden | 124/78 |
| 3,815,567 | 6/1974 | Serra | 124/78 |
| 3,913,552 | 10/1975 | Yarur et al. | 124/78 |
| 3,976,295 | 8/1976 | Heald | 273/DIG. 8 X |

OTHER PUBLICATIONS

"LD-167 A Liquid Urethane Elastomer Yielding Very Hard Vulcanizates"—Development Products Report No. 12 Oct. 1958 E. I. Du Pont de Nemours & Co. (Inc.). Wilmington 98, Del.

*Primary Examiner*—William R. Browne
*Attorney, Agent, or Firm*—Klarquist, Sparkman, Campbell, Leigh, Hall & Whinston

[57] ABSTRACT

A baseball pitching machine includes a pair of adjacent ball engaging wheels each provided with a groove or concave surface formed in a body of an elastomeric material. As the baseball is received between the grooved wheels, the groove edges are laterally distorted, since the edges are unrestrained, to grip the baseball securely on opposite sides thereof and pitch the baseball in an accurately predetermined direction.

14 Claims, 7 Drawing Figures

COACTING WHEEL BALL PROJECTING DEVICE

BACKGROUND OF THE INVENTION

This invention relates to ball pitching machines and particularly to such a machie for pitching a baseball in an accurately predetermined direction.

Baseball pitching machines of the type heretofore available have almost universally employed a pair of oppositely rotating pneumatic tires between which a baseball is received for propelling or pitching the baseball in a trajectory tangential to the tire peripheries. The pneumatic tires are closely enough spaced to compress as they receive the baseball therebetween and will impel the baseball at a velocity determined by the speed of rotation of the tires. Great care must be taken to insure proper inflation of the tires so they will properly receive the baseball, but even if care is taken and the baseball is correctly channeled between the pneumatic tires, there is considerable danger of the ball sliding off to one side or the other and being projected sidewise of a plane containing the two tires. This situation can become especially pronounced as the pneumatic pressure in one or both of the tires lessens. Moreover, irregularities in the pneumatic tires and particularly the tread portions affects the direction the baseball is pitched.

Most known baseball pitching machine locate both of the ball engaging pneumatic tires in a horizontal plane, or at most at some angle to the horizontal. It would be desirable to be able to position the ball engaging wheels in a vertical plane for more accurately simulating many of the balls actually thrown by a human pitcher, but a batter is justifiably wary of such an arrangement because of the danger of being struck by the baseball.

Tennis ball propelling machines have been proposed which include vertically disposed ball engaging wheels, but depend upon the compressibility of the tennis ball for their operation. Thus, a pair of rigid ball projecting wheels may be closely enough spaced so that the tennis ball is securely compressed between the wheel peripheries to be thrown outwardly as the wheels rotate in opposite directions. However, wheels of this type are obviously inappropriate for throwing a much harder baseball. While wheels of some tennis ball projecting machines or the like have been provided with a friction coating or layer to insure adequate engagement of the ball without slippage, such frictional coatings are not generally compressible to a degree for adequately receiving a hard baseball, while at the same time being capable of consistently projecting the baseball in a desired direction.

SUMMARY OF THE INVENTION

In accordance with the present invention, a baseball pitching machine includes at least one motor driven, rotatable, ball engaging wheel for pitching a baseball tangentially, wherein the circumference of the ball engaging wheel includes a body of elastomeric material. The body of elastomeric material is formed with a peripheral groove providing a concave cross section in said body of elastomeric material extending circumferentially around the perimeter of the wheel to receive the baseball and accurately channel the trajectory of the baseball. Preferably, a pair of such wheels are disposed with their grooves in juxtaposition and closely enough spaced so that reception of the baseball therebetween compresses the elastomeric material. The compression of the elastomeric material spreads or distorts flange edges on either side of the aforementioned grooves to provide a firm, finger-like grip on the sides of the baseball. Thus, for vertically disposed ball engaging wheels, a pair of elastomeric flange edges on the top wheel are distorted to grasp the ball firmly on opposite sides thereof, while a pair of similarly distorted flange edges in the elastomeric material of the bottom wheel also securely grip the ball on either side thereof. As the wheels are rapidly rotated in opposite directions, the ball is accurately thrown in a predetermined direction, and as a consequence allowing vertical disposition of the wheels without causing danger to the batter.

It is accordingly an object of the present invention to provide an improved ball pitching machine for accurately pitching a baseball in a predetermined direction.

It is a further object of the present invention to provide an improved ball pitching machine less subject to inaccuracies in pitching direction and consequent danger to personnel as compared with prior machines.

It is another object of the present invention to provide an improved ball pitching machine which is less subject to wear and long term inaccuracies than machines heretofore available.

It is a further object of the present invention to provide an improved ball pitching machine wherein the ball pitching wheels thereof may be disposed in a substantially vertical plane.

It is a further object of the present invention to provide an improved ball pitching machine which is durable and predictable in operation although economical in construction.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

DETAILED DESCRIPTION

Figure 1:
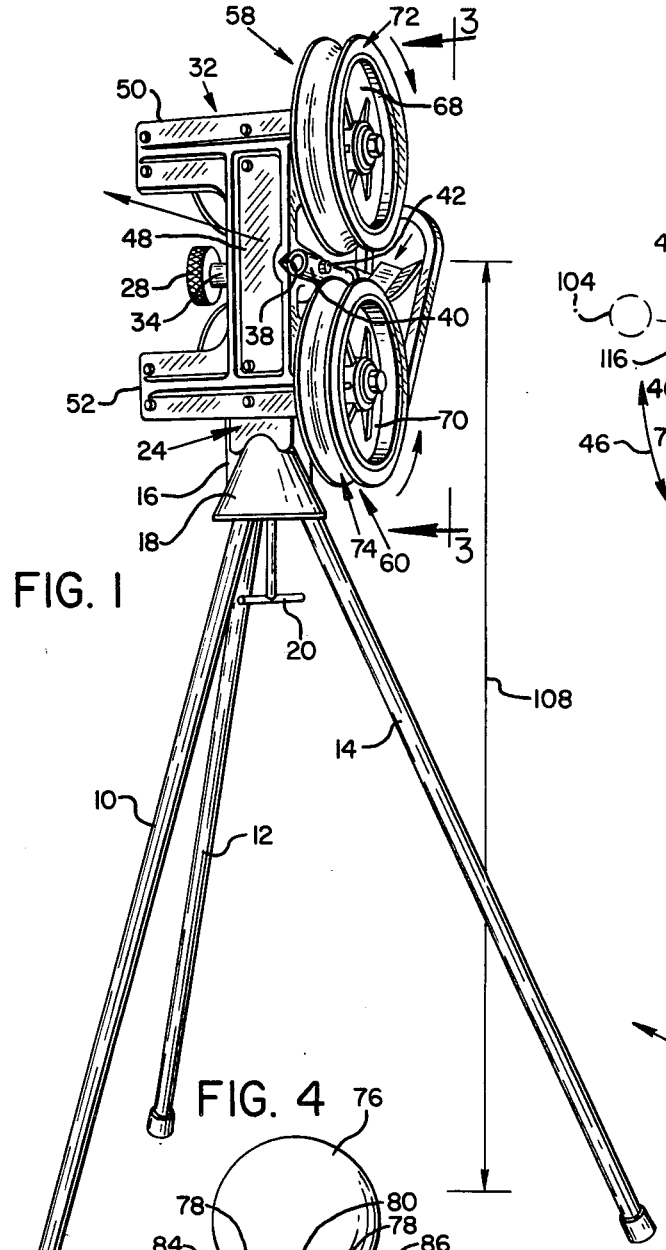
FIG. 1 is a front perspective view of a pitching machine according to the present invention.
Figure 2:
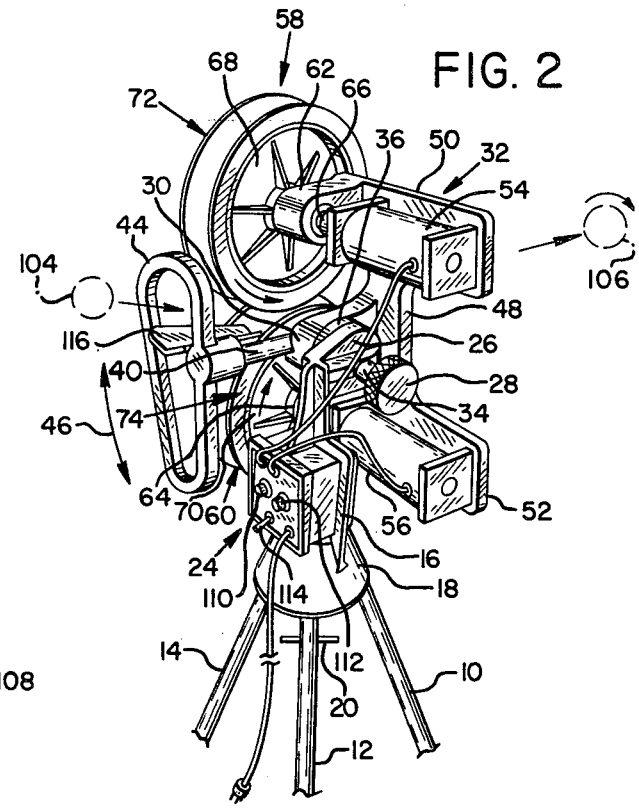
FIG. 2 is a perspective view, partially broken away, of the pitching machine according to the present invention as viewed partly from the rear.
Figure 3:
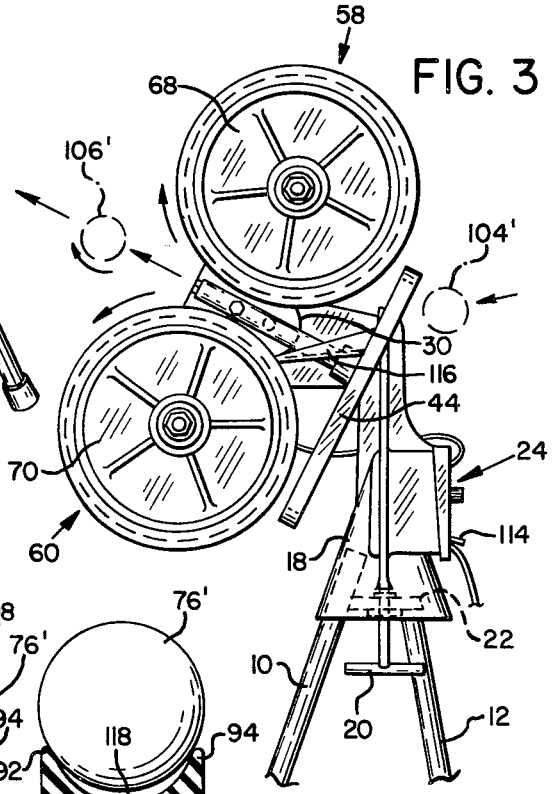
FIG. 3 is a side view, partially broken away, of the pitching machine according to the present invention.

Referring to the drawings, and particularly to FIGS. 1 through 3, a pitching machine includes a tripod stand comprising legs 10, 12 and 14 secured to a lower metal casting 16 provided with a lower conical skirt 18 for receiving the three legs. A T-shaped handle 20 has a threaded shank matingly received within the lower casting and carries a rotatable washer 22 adapted for forcing the legs 10, 12 and 14 outwardly against the skirt 18 as handle 20 is tightened. The legs are positioned in grooves (not shown) on the inner side of skirt 18. Casting 16 also supports a control panel box 24 adapted for adjusting motor speed as hereinafter more fully described.

Casting 16 includes an upper, flat-sided ear portion 26 centrally apertured to receive the shank of adjusting knob 28. The shank of the adjusting knob is threadably received in central bracket 30 of upper metal casting 32 which is spaced from ear portion 26 by nylon washer 36. The adjusting knob shank has a larger diameter shoulder 34 which bears against ear portion 26 as knob 28 is tightened for holding casting 32 in a designated angular position relative to casting 16.

The side of central bracket 30 opposite nylon washer 36 is grooved at 38 to receive a rod or pipe 40 secured thereto by screw 42 and extending rearwardly to receive a yoke-shaped handle 44 at its opposite end. As hereinafter more fully described, handle 44 is utilized for adjusting the pitching angle upwardly and downwardly in the directions of arrow 46 when knob 28 is loosened, and for carrying the upper part of the pitching machine when the legs are disassembled therefrom.

Casting 32 includes a generally vertical leg 48 supported by central bracket 30, and upper and lower legs 50 and 52 which extend horizontally from leg 48 above and below bracket 30 and in perpendicular relation thereto. The legs 50 and 52 carry motors 54 and 56 respectively, which are employed for rotatably driving ball engaging wheels 58 and 60. The ball engaging wheels are secured to parallel horizontal shafts rotatably supported in bearing members 62 and 64 and connected to the motor shafts via flexible couplings, e.g. coupling 66 positioned between the rotating shaft of motor 54 and the driven shaft of the ball engaging wheel 58. Bearing members 62 and 64 are respectively supported upon legs 50 and 52 of the casting 32 and position the wheels in spaced, vertical alignment.

The ball engaging wheels 58 and 60 are rotated in opposite directions and are spaced to receive a baseball therebetween for propelling the ball tangentially forward. Thus, the ball indicated at 104 is received on chute 116 attached to handle 44, and the wheels 58 and 60 are rotated in the directions indicated for propelling the ball forwardly as shown at 106 in FIG. 2. Each of the wheels preferably includes a rigid central hub portion of cast aluminum suitably having a flat cylindrical rim about ten inches in diameter for supporting a body or tire of elastomeric material. For instance, wheel 60 includes an aluminum hub portion 70 having a cylindrical rim 82 which supports a body 74 of elastomeric material. (See FIGS. 4 and 5.) Similarly, wheel 58 comprises an aluminum hub 68 carrying a cylindrical rim 83 upon which elastomeric body 72 is mounted. Each such elastomeric body is formed with a peripheral groove providing a concave cross section in said body extending circumferentially around the perimeter of the wheel for receiving a baseball and for channeling the trajectory of the baseball when the wheel rotates. The baseball with then be pitched in a controllable, forward direction.

Figure 4:
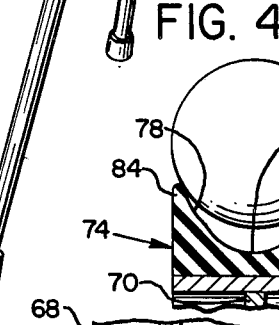
FIG. 4 is a partial cross-sectional view of a ball engaging wheel according to a first embodiment of the present invention.
Figure 5:
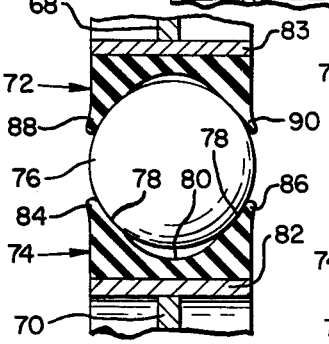
FIG. 5 is a partial cross-sectional view of a pair of ball engaging wheels according to the FIG. 4 embodiment.

Considering particularly FIGS. 4 and 5, elastomeric body 74 is grooved around the periphery thereof to supply a concave ball engaging surface. The concavity of the groove includes a first radius of curvature as indicated at 78 in FIG. 4 on either side of body 74 and a central, smaller radius of curvature is indicated at 80, the latter radius of curvature extending more deeply into body 74 to provide greater relief underneath the baseball 76 received thereupon. It is understood the curvature as indicated at 78 is a part of the same circular arc cross section even though separated by curvature 80. The wheels 58 and 60 are in general spaced more closely than the diameter of baseball 76 whereby the baseball 76 is grasped therebewteen as a result of the compression of the elastomeric body 74 and compression of the opposite elastomeric body 72.

On either side of the concave cross section, flange edges 84 and 86 are defined in body 74 where the elastomeric body 74 is substantially thicker as measured from rim 82. As stated, ball engaging wheels 58 and 60 are generally spaced more closely together than the diameter of baseball 76 whereby the elastomeric material is compressed when the baseball is received between the wheels. As a result of this compression, the flange edges 84 and 86 spread laterally outwardly when receiving the baseball, and provide a finger-like grip on either side thereof such as illustrated in FIG. 5. It is noted the portion of the groove having the first radius of curvature 78 grasps the exterior of the baseball, while the body of elastic material is relieved away from the baseball at the locaton of the smaller radius of curvature 80. The body 72 of elastomeric material received on the opposite wheel 58 similarly includes a pair of flange edges 88 and 90 which are located on either side of the peripheral groove in body 72 and which spread so as to engage the baseball in a finger-like grip between the flange edges as the baseball is received between the two wheels.

In FIG. 4, the relationship between the ball 76 and a body of elastomeric material 74 is illustrated as it would be without compression of the elastomeric material. It is seen the radius of curvature at 78, as well as the radius of curvature at 80, are both smaller than the radius of baseball 76. Thus, as the baseball is being urged between the partially within the concave cross sections formed by bodies 72 and 74, the elastomeric material does spread to provide the finger-like gripping action. It has been stated the wheels 58 and 60 are in general more closely spaced than the diameter of the baseball. It is not meant to infer the spacing from the trough of the groove in one wheel to the trough of the groove in the other wheel must be less than the diameter of a baseball, but rather the wheels are closely enough spaced so that some compression takes place in the elastomeric material at flange edges 84, 86, 88 and 90 to produce the above described gripping action. Moreover, while a two-wheel machine is much preferred wherein adjacent grooves are juxtaposed for receiving the ball therebetween, it will be apparent that a pitching machine may also be constructed with one ball engaging wheel facing a panel, chute or abutment acting to urge the ball toward and partially into the concave cross section of the groove of the body of elastomeric material on the single wheel.

Figure 7:
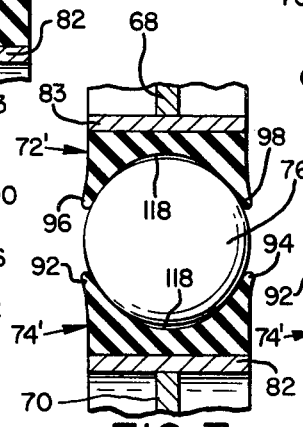
FIG. 7 is a partial cross-sectional view of a pair of ball engaging wheels according to the FIG. 6 embodiment.
Figure 6:
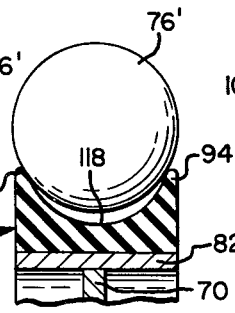
FIG. 6 is a partial cross-sectional view of a ball engaging wheel according to a second embodiment of the present invention.

A preferred embodiment of the present invention is illustrated in FIGS. 6 and 7 wherein each of elastomeric bodies 72' and 74', extending around rims 83 and 82 respectively, is provided with a groove having but one radius of curvature as illustrated at 118 in FIG. 6. This radius of curvature is less than the radius of baseball 76' which is shown relative to the body 74' in noncompressed condition in FIG. 6. On either side of the groove to which radius 118 pertains, flange edges 92 and 94 are defined which are forced transversely outwardly as illustrated in FIG. 7 when baseball 76' is received between the two elastomeric bodies. Thus, the baseball is grasped between finger-like flange edges 92 and 94 on one side of the baseball which are distorted outwardly to obtain a firm grip on the baseball therebetween, and similarly distorted flange edges 96 and 98 on the opposite side of the baseball. The spacing of the wheels may be such that the radius of curvature 118 at the trough of the groove is relieved slightly away from the baseball during machine operation, or alternatively the baseball may fill up the opening between the two wheel grooves and "bottom out" against the trough or low point of each groove. The finger-like gripping action of the flange edges is still effective for grasping and controlling the trajectory of the baseball. However, it is preferred the baseball "bridge" between the aforementioned flange edges. In the at-rest or non-stressed condition, the thickness of the elastomeric material above the hub rim is preferably about $\frac{3}{8}$ inch to $\frac{1}{2}$ inch or thicker, especially at the flange edges, in either the embodiment of FIGS. 6, 7 or the embodiment of FIGS. 4, 5 to insure desired compressibility. In the illustrated embodiments, the thickness of the elastomeric material is $\frac{1}{2}$ inch at the trough or low point of the groove. In any event, assuming flat or cylindrical hub-rims, the elastomeric body is materially thicker at the flange edges in the at-rest condition or otherwise, e.g. by at least $\frac{3}{8}$ to $\frac{1}{2}$ inch. Although the elastomeric bodies are illustrated and described herein as desirably mounted on rigid metal hubs, it is also possible to form the entire wheel from a suitable elastomeric material, thereby obviating the use of the hubs.

Various materials may be employed for the elastomeric bodies. For instance, a suitable natural or synthetic rubber may be employed. However, other substances are preferred, from the standpoint of accurate ball-throwing operability according to the present invention as well as durability in maintaining the desired dimensions and exhibiting a long working lifetime. A preferred material is a so-called solid elastomer having a Shore durometer hardness of approximately 40A or greater, and particularly a polyurethane elastomer of that hardness. In one example, this elastomeric material was formed from Solithane 291 urethane prepolymer manufactured by Thiokol Chemical Division, Trenton, N.J. The Solithane urethane prepolymer is preheated to about 100° to 110° C. and degassed at a vacuum of about 29 inches of mercury. A curing agent, such as Isonol 93 manufactured by the Upjohn Co., Kalamazoo, Mich., is heated to the same temperature and combined with the prepolymer, blending thoroughly. The mixture of the prepolymer and the curing agent is degassed and the blend is poured into a mold for shaping the tire body 72 or 74 to have the cross section as illustrated in FIG. 4 or FIG. 6 in its formed or unstressed condition. The blend is molded onto the rigid aluminum hub, the rim of which may be roughened first. After about an hour, the tire body is removed from the mold and cured in a circulating hot air oven for 24 hours at about 100° F. A small quantity of plasticizer such as Kodaflex DMOEP manufactured by the Eastman Kodak Company, Rochester, N. Y. may be added to the curing agent. The plasticizer is added in an amount sufficient for softening or adjusting the hardness of the resulting polyurethane to approximately 40A durometer as hereinbefore mentioned.

Alternatively, a vinyl elastomer may be employed as formed from a plastasol of vinyl and a plasticizer such as dioxyphthalate. The plastasol is poured in a mold at an elevated temperature for heat curing the substance as understood by those skilled in the art. The plastasol is suitably approximately 30% vinyl and 70% plasticizer. As yet a further alternative, silicone elastomer can also be employed for the bodies of elastomeric material.

Although a Shore durometer hardness of about 40A is preferred for the bodies of elastomeric material, such material may suitably have a hardness in the range between 30A and 50A.

The pitching machine according to the present invention has particular advantage because of its ability to channel the ball to center and pitch the same into a true controlled trajectory tangential to the ball engaging wheels as determined by the grooved wheel periphery. As a consequence, the wheels may be substantially vertically mounted as shown, without substantial danger of the ball being improperly directed to one side or the other because of noncentering. The trajectory of the ball is controlled for longer distances, and also this control is effective for longer periods of time than would be possible, for example, in the case of pneumatic tires which tend to lose pressure. Thus, the pitched ball may be accurately propelled to a consistent, on-target position. The machine according to the illustrated embodiment is supported by its tripod stand well above ground level. Thus, the dimension 108 in FIG. 1 is suitably approximately five feet.

Vertical adjustment can be made in the direction the ball is pitched, for example between a pitch in a substantially horizontal direction with the machine positioned as shown in FIGS. 1 and 2, and a more angular upward direction with the machine positioned as illustrated in FIG. 3. Knob 28 is appropriately loosened and handle 44 is utilized for moving the upper part of the machine to the desired angular position as indicated by arrow 46. Then, knob 28 is tightened to hold castings 32 and 16 in the desired relationship.

The speed of the respective motors 54 and 56 can be adjusted by means of electrical rheostatic controls operated by knobs 110 and 112 on the control panel. Switch 114 is employed for disconnecting the motors from a source of power. By simultaneously increasing the speed of the two motors, the speed with which the ball is projected can be increased. With both motors operating at relatively the same speed, a straight ball is "thrown" simulating a knuckle ball or floater, or a pitch with substantially no spin or rotation. For fielding practice, this type of ball projection simulates a ball hit squarely by the bat such as a line drive or fly ball. By increasing the speed of the top wheel and/or decreasing the speed of the bottom wheel, a ball is projected which has a tendency to drop or curve downwardly because of the spin imparted to the top of the ball as illustrated by the arrow adjacent ball 106 in FIG. 2. For fielding practice, this type of spin simulates a "grounder". By increasing the speed of the bottom wheel and/or decreasing the spin of the top wheel, a ball is thrown which has a tendency to rise or curve upwardly, such as a fast ball, because of the spin imparted to the bottom of the ball as illustrated by the arrow adjacent ball 106' in FIG. 3. This type of spin also simulates a ball hit off the top of the bat such as a high fly ball utilized for outfield practice.

Although the ball engaging wheels are illustrated as being disposed in a vertical plane, and such configuration is preferred, it is clear the ball engaging wheels may be disposed in a horizontal plane if so desired, or at an angular position between the vertical and horizontal. In such cases, various horizontally curved pitches can be simulated as desired.

While I have shown and described plural embodiments of my invention, it will be apparent to those skilled in the art that many other changes and modifications may be made without departing from my invention in its broader aspects. I therefore intend the appended claims to cover all such changes and modifications as may fall within the true spirit and scope of my invention.

I claim:

1. A ball pitching machine comprising:

at least one motor-driven, rotatable, ball engaging wheel for pitching a baseball tangentially of said wheel, the circumference of said ball engaging wheel including a body of elastomeric material, said body being formed with a peripheral groove providing a concave cross section in said body extending circumferentially around the perimeter of said wheel for receiving said baseball and channeling the trajectory of said baseball as said wheel rotates to pitch said baseball, said body of elastomeric material including flange edges on either side of said concave cross section, said concave cross section having a first radius of curvature proximate said flange edges and a second smaller radius of curvature centrally of the concave cross section extending more deeply into said body of elastomeric material to provide a relieved indentation underneath a baseball received within the concave cross section, a stand for supporting said ball engaging wheel, and means in juxtaposition with said ball engaging wheel for urging said baseball toward and partially within said concave cross section of said body of elastomeric material so that said elastomeric material grips said baseball.

2. A ball pitching machine comprising:

at least one motor-driven, rotatable, ball engaging wheel for pitching a baseball tangentially of said wheel, said ball engaging wheel comprising a body of elastomeric material, said body being preformed with a peripheral trough extending circumferentially around the perimeter of said wheel for receiving said baseball and channeling the trajectory of said baseball as said wheel rotates to pitch said baseball, said body of elastomeric material having a first thickness in a direction radial of said wheel for defining said trough and a substantially larger thickness in a direction radial of said wheel at locations on either side of said trough, said larger radial thicknesses forming self-supporting radially outwardly extending flange edges comprised entirely of elastomeric material otherwise unrestrained against movement in the lateral direction of said wheel as a ball is received in said trough, said flange edges providing a gripping action, a stand for supporting said ball engaging wheel, and means in juxtaposition with said ball engaging wheel for urging said baseball toward and at least partially within said trough.

3. The apparatus according to claim 2 wherein said wheel comprises a central, substantially rigid hub portion having said body of elastomeric material mounted on the rim thereof, said rim being cylindrical with said substantially larger thickness of said body of elastomeric material being substantially thicker as measured radially outwardly from said cylindrical rim to provide the formation of said flange edges, said rim having a substantially constant outer radius lacking rigid flange portions as would inhibit lateral movement of said flange edges which are comprised entirely of elastomeric material.

4. A ball pitching machine comprising:

at least one motor-driven, rotatable, ball engaging wheel for pitching a baseball tangentially of said wheel, the circumference of said ball engaging wheel including a body of elastomeric material, said body being preformed with a peripheral groove providing a concave cross section in said body extending circumferentially around the perimeter of said wheel for receiving said baseball and channeling the trajectory of said baseball as said wheel rotates to pitch said baseball, wherein said concave cross section on either side of said ball is narrower than would fully accept said ball therewithin and is dimensioned to make initial contact with said ball at substantially two locations on either side thereof while being relieved away from said ball under said ball, with said urging of said ball causing said ball to be more deeply received within said concave cross section for contact therewith as said body of elastomeric material spreads apart laterally while unrestrained to receive said ball more fully for grasping said ball and channeling the trajectory thereof, a stand for supporting said ball engaging wheel, and means in juxtaposition with said ball engaging wheel for urging said baseball toward and partially within said concave cross section of elastomeric material so said elastomeric material grips and baseball.

5. The apparatus according to claim 4 wherein said means in juxtaposition comprises a second motor driven, rotatable, ball engaging wheel also supported by said stand, the circumference of said second ball engaging wheel also including a body of elastomeric material, the last mentioned body being formed with a peripheral groove providing a concave cross section in said body extending circumferentially around the perimeter of the second wheel, said wheels being rotatable on substantially parallel shafts in opposite rotational directions with said grooves in facing juxtaposition and generally more closely spaced than the diameter of a baseball to receive the baseball between and within said concave cross sections in compressive relation to said bodies of elastomeric material.

6. The apparatus according to claim 4 wherein the radial thickness of said body of elastomeric material is at least approximately three-eighths to one-half inch or greater.

7. The apparatus according to claim 6 wherein said elastomeric material has a Shore durometer hardness in the range of 30A to 50A.

8. The apparatus according to claim 6 wherein said elastomeric material has a Shore durometer hardness of approximately 40A or greater.

9. The apparatus according to claim 4 wherein said elastomeric material comprises a polyurethane elastomer.

10. The apparatus according to claim 4 wherein said elastomeric material comprises a polyurethane elastomer having a Shore durometer hardness approximately in the range of 40A to 50A.

11. The apparatus according to claim 4 wherein said elastomeric material comprises a vinyl elastomer.

12. The apparatus according to claim 4 wherein said elastomeric material comprises a silicone elastomer.

13. The apparatus according to claim 4 wherein said elastomeric material comprises a solid elastomer.

14. A ball pitching machine comprising:

at least one motor-driven, rotatable, ball engaging wheel for pitching a baseball tangentially of said wheel, the circumference of said ball engaging wheel including a body of elastomeric material, said body being preformed with a peripheral groove providing a concave cross section in said body extending circumferentially around the perimeter of said wheel for receiving said baseball and channeling the trajectory of said baseball as said wheel rotates to pitch said baseball, wherein said body of elastomeric material includes flexible flange edges on either side of said concave cross section providing initial contact points which contact the ball received by said concave cross section, wherein the distance between said initial contact points is less than corresponding points on the arc of said ball if said ball were forced within said concave cross section, said body of elastomeric material between said contact points being relieved from the arc of said ball as it initially bridges between said contact points, while said urging of said ball within said concave cross section causes said flange edges to spread laterally to receive said ball as said ball is more fully grasped by said concave cross section, a stand for supporting said ball engaging wheel, and means in juxtaposition with said ball engaging wheel for urging said baseball toward and partially within said concave cross section of said body of elastomeric material so said elastomeric material grips said baseball.

* * * * *

UNITED STATES PATENT AND TRADEMARK OFFICE

CERTIFICATE OF CORRECTION

PATENT NO. : 4,197,827

DATED : April 15, 1980

INVENTOR(S) : Tommy L. Smith

It is certified that error appears in the above—identified patent and that said Letters Patent is hereby corrected as shown below:

Column 1, line 6, "machie" should be --machine--.

Column 1, line 27, "machine" should be --machines--.

Column 3, line 62, "with" should be --will--.

Column 4, line 9, "therebewteen" should be --therebetween--

Column 4, line 40, "the", first occurrence, should be --and--.

Column 8, line 40, "and" should be --said--.

Signed and Sealed this

Ninth Day of February 1982

[SEAL]

Attest:

GERALD J. MOSSINGHOFF

Attesting Officer

Commissioner of Patents and Trademarks